US005429269A

United States Patent [19]

Mejias

[11] Patent Number: 5,429,269

[45] Date of Patent: Jul. 4, 1995

[54] ICE CUBE CONTAINING AND DISPENSING DEVICE

[76] Inventor: Tomas B. Mejias, C/Emigrante, 26,, E-08906 L'Hospitalet de Llobregat, Spain

[21] Appl. No.: 157,207

[22] PCT Filed: Apr. 27, 1993

[86] PCT No.: PCT/ES93/00031

§ 371 Date: Dec. 8, 1993

§ 102(e) Date: Dec. 8, 1993

[87] PCT Pub. No.: WO93/22607

PCT Pub. Date: Nov. 11, 1998

[30] Foreign Application Priority Data

May 4, 1992 [ES] Spain ..... 9200915
Mar. 24, 1993 [ES] Spain ..... 9300598

[51] Int. Cl.[6] ..... G07F 11/72

[52] U.S. Cl. ..... 221/150 R; 221/202; 221/262; 221/263

[58] Field of Search ..... 62/344; 221/150 R, 200, 221/202, 257, 262, 263, 281

[56] References Cited

U.S. PATENT DOCUMENTS 1,103,952 7/1914 Fisher ..... 221/200 X
3,561,231 2/1971 Webb ..... 62/344
3,572,053 3/1971 Jacobus et al. ..... 62/344
4,055,053 10/1977 Elfving et al. ..... 62/344 X
4,088,243 5/1978 Deveson ..... 221/150 R X
4,913,315 4/1990 Wagner ..... 221/200
4,920,764 5/1990 Martin ..... 221/150 R X
5,029,737 7/1991 Yamamoto ..... 62/344 X

FOREIGN PATENT DOCUMENTS 449088 6/1948 Canada ..... 221/200 X
3323898 1/1985 Germany ..... 62/344 X

*Primary Examiner*—David H. Bollinger
*Assistant Examiner*—Dean A. Reichard
*Attorney, Agent, or Firm*—Steinberg, Raskin & Davidson

[57] ABSTRACT

An ice cube containing and dispensing device having a thermally insulating receptacle with a cooling unit, a mechanism for dispensing individual ice cubes including a lever with a pushbutton, a movable platform which closes an ice cube outlet of the receptacle and on which an ice cube is deposited as it awaits opening of the outlet, a stop attached to the lever which intercepts passage of the ice cubes toward the outlet, and a trapdoor which closes off the passage of the ice cubes from the receptacle. In another embodiment, a hopper holds the ice cubes in an interior thereof and has a separate enclosing chamber provided with orifices which connect it to the interior of the hopper. Heat exchange components of a cooling unit are arranged above the hopper. The cold from evaporators is distributed uniformly through the enclosing chamber.

15 Claims, 6 Drawing Sheets 1600
1700
1400
1800
1500
200a
900
200a
1200
1300
1300
1200
800
100
1100
3100
2600
700
2200
2500
2700
800a
2400
2100
3000
2800
2900
2300
1000
1900
2000
600
500
300
400

ICE CUBE CONTAINING AND DISPENSING DEVICE

The present invention refers to an ice cube containing and dispensing device which keeps the ice cubes in a solid state thanks to a conventional cooling unit, and allows them to be supplied one by one in a very practical manner.

BACKGROUND OF THE INVENTION

In bars and public places where drinks are supplied the ice cubes remain in their moulds inside a conventional refrigerator, from which they are transferred to an ice bucket consisting of a containing receptacle, which is at best thermally insulated. Anybody needing to use the ice cubes takes them from the receptacle in question, into which new ice cubes from the refrigerator have to be placed from time to time.

This system of conservation and use of ice cubes presents several drawbacks:

- Ice cubes which remain too long in the receptacle melt.
- It is a nuisance to have to continually fill the receptacle with new ice cubes from the refrigerator to avoid them remaining too long in the receptacle and therefore melting.
- The ice cubes contained in the receptacle stick to each other easily, which makes them difficult to be used one by one.

DESCRIPTION OF THE INVENTION

The ice cube containing and dispensing device object of the invention was designed in order to solve the drawbacks outlined above.

In a first embodiment the device in question comprises a thermally insulating receptacle incorporating a cooling unit of a conventional type, provided with an ice-cube loading opening with an enclosure cover. On the basis of this general embodiment, the device is essentially characterized in that the receptacle presents a configuration in the form of a hopper with a lower outlet opening for the ice cubes to emerge one by one, a manually operated mechanism being placed within said receptacle and comprising a series of levers and stops, which tend to remain in a stable rest position in which they intercept the passage of the ice cubes towards the receptacle outlet. When operated manually, the mechanism allows sequential passage of the ice cubes one by one, first to a waiting platform and, finally, to the outlet opening.

The inner mechanism of the receptacle consists of a swivelling lever provided with a projecting section under the ice cube outlet opening in the form of a pushbutton, bearing a platform which closes off said opening. This lever is attached to an inner upper stop which, when the mechanism is in rest position, prevents the passage of the ice cubes towards the platform. Said stop allows the ice cubes to pass when the mechanism is operated manually. The mechanism further comprises an intermediate trapdoor, arranged between the aforesaid stop and the platform and operated by the lever itself, which in rest position is inactive and when the pushbutton is pressed moves to a position in which it intercepts the passage of the ice cube which has gone beyond the upper stop, preventing it from reaching the platform until the mechanism returns to the rest position.

Under the load opening of the receptacle there is a grille provided with openings which match the size of the ice cubes, thus preventing the passage of two or more ice cubes stuck together.

The receptacle is mounted in a raised position on a base supporting the device on a horizontal surface. This base has a tray-type configuration placed beneath the ice cube outlet opening, at a distance sufficient to allow the positioning of a glass for receiving the ice cubes supplied by the device.

In a second version, the ice cube container hopper is formed by a double wall which makes up an enclosing chamber connected to the interior of the hopper by means of orifices in its inner wall, said chamber being linked to an area in which the heat exchange components are situated.

The heat exchange components are placed beside the upper ice cube inlet opening, i occupying closed housings provided with orifices near the bottom, which link with the enclosing chamber of the hopper.

The cube entrance cover is provided with a flexible plate in the form of a watertight gasket, which keeps cold the interior of the hopper.

On the two arms of the mechanism operating lever there is a stop on which the swivelling trapdoor rests, which has a prolongation in the shape of a flexible wing and a long opening through which there passes a rod forming a single piece with the lever, which guides the swivelling movement of the trapdoor on being operated by the lever when the lever adopts the position for outlet of the ice cube situated on the waiting platform.

The arms of the lever are provided with a series of projecting rods oriented towards the interior of the hopper, which move the ice cubes each time the lever is operated.

BRIEF DESCRIPTION OF THE DRAWINGS

For a better understanding of all that has been set forth herein, there are attached some drawings in which, only by way of example, a practical case of embodiment of the ice cube containing and dispensing device is shown.

In said drawings

The second version of the device is shown by the following figures.

DESCRIPTION OF A PREFERRED EMBODIMENT

The ice cube containing and dispensing device comprises, in the first version illustrated in FIGS. 1 to 5 of the drawings, a thermally insulating receptacle -1- incorporating a conventional-type cooling unit of general reference -2-. The receptacle -1- is mounted on a support -3- which rises from a base -4- provided with feet which support the device on a horizontal surface.

The base -4- has the form of a tray and allows the passage of a glass -6- which receives ice cubes -7- from inside the receptacle -1-, which has the form of a hopper -1*a*-, with a lower opening -8- for the outlet of the ice cubes -7- one by one.

The receptacle -1- is provided with an upper loading opening -9- with a cover -10-. Beneath the opening -9- there is a grille -11- with openings -12- of dimensions corresponding to those of an ice cube, thus preventing the passage of two or more ice cubes stuck together.

Inside the hopper -1*a*- is mounted a mechanism which dispenses the ice cubes one by one and comprises the components described below:

An elbowed lever -13- which turns around a spindle -14-, which comprises two fork-like arms -15-, linked to a platform, which in the rest position of mechanism closes off the lower opening -8-. The receptacle -1- is mounted on a support -3- which rises from a base -4- provided with feet which support the device on a horizontal surface.

A pushbutton -17- projecting to the exterior beneath the opening -8-, which is pushed by the glass -6- to make the ice cubes emerge one by one.

A stop -18- formed by a bent rod, the ends of which are attached to the spindle -14- and to the lever -13-. This stop, in rest position, intercepts the passage of the ice cubes -7- situated in the hopper -1*a*- moving in the direction of the outlet opening -8-.

A trapdoor -19- turns around a spindle -20-. This trapdoor rests on lugs -21- on the lever -13-, so that when the lever turns it operates the trapdoor, placing it in a position to intercept the passage of any ice cube which had passed the stop -18-. The trapdoor -19- is provided with a tooth -22- which, in rest position, rests against the lugs -21-, limiting the swivel of said trapdoor.

Figure 1:
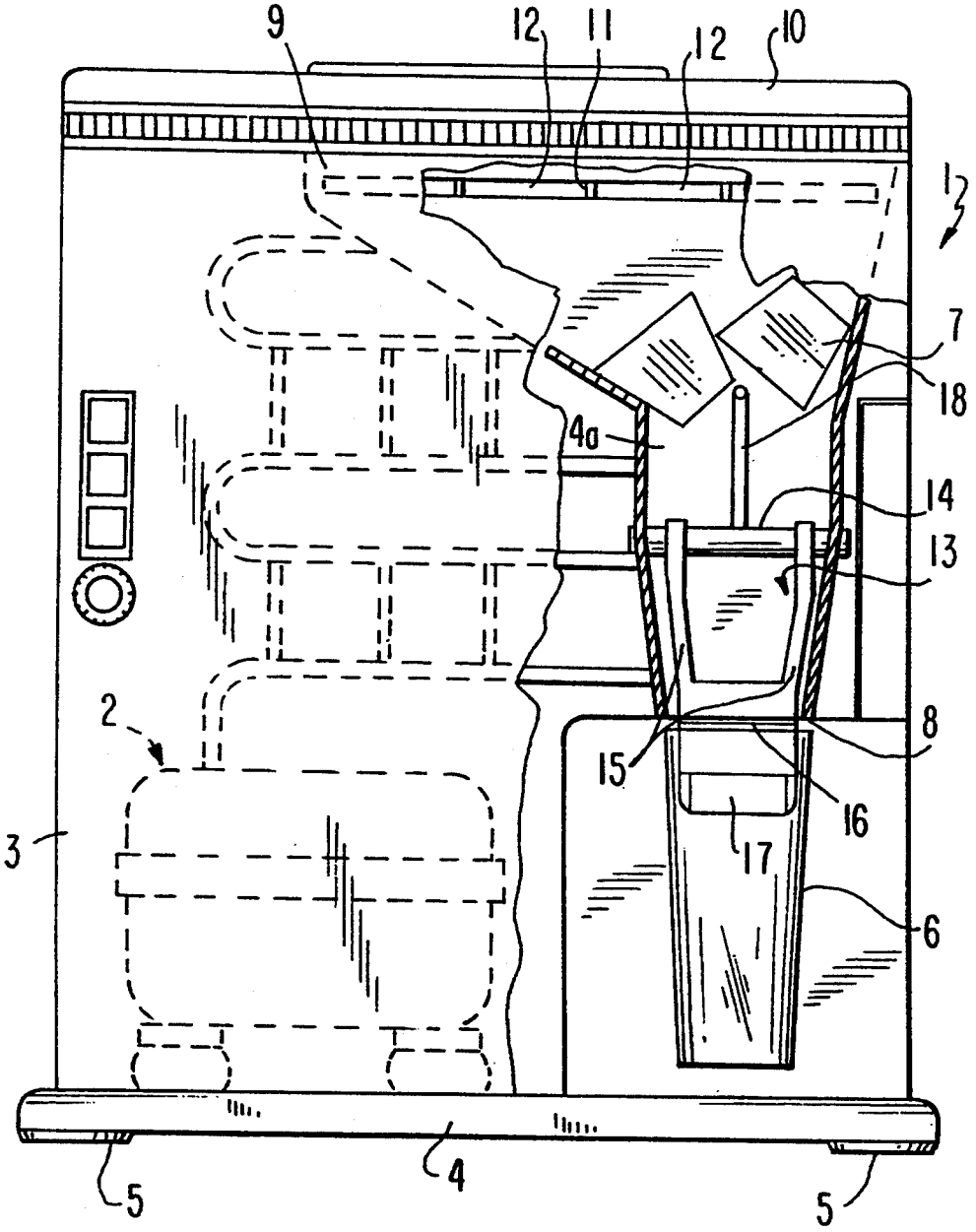
FIG. 1 is a front elevation view, partially sectioned, of the device with the ice cube delivery mechanism in rest position.
Figure 2:
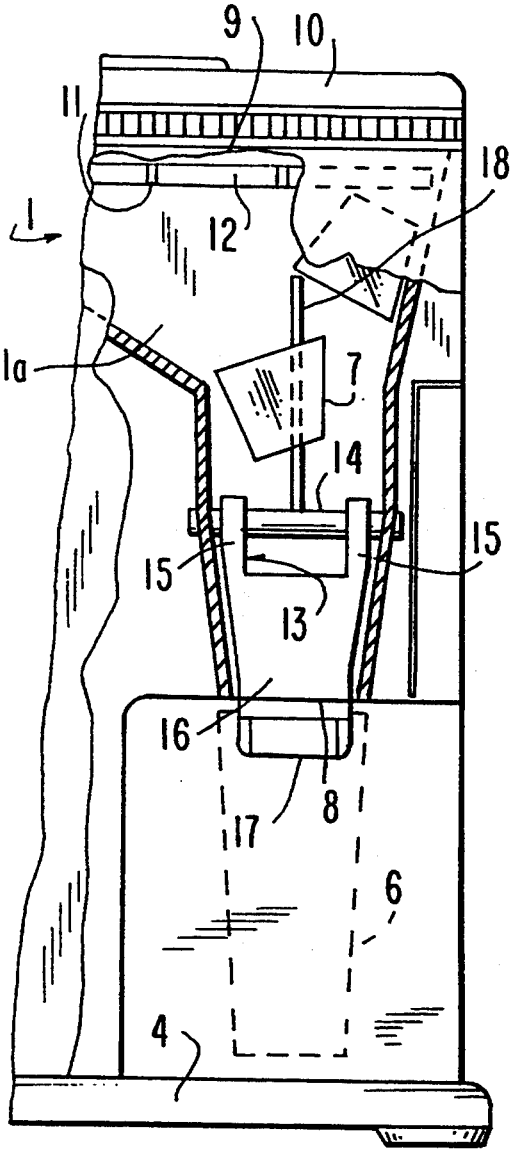
FIG. 2 is a front elevation detail, with the delivery mechanism in working position.
Figure 3:
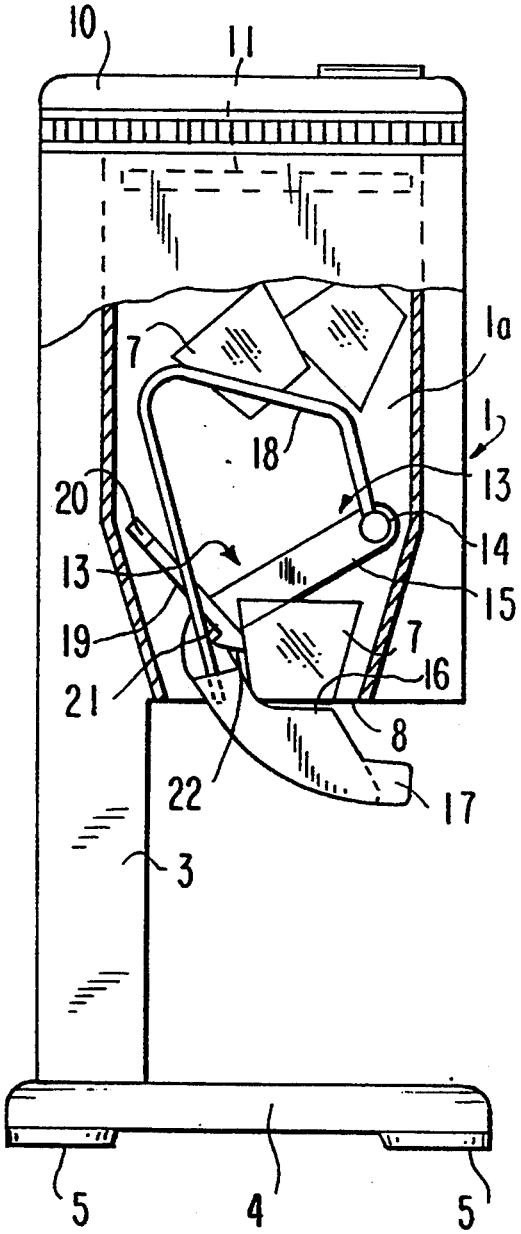
FIG. 3 is a side elevation view of the device with the receptacle sectioned longitudinally, showing the delivery mechanism in rest position.
Figure 4:
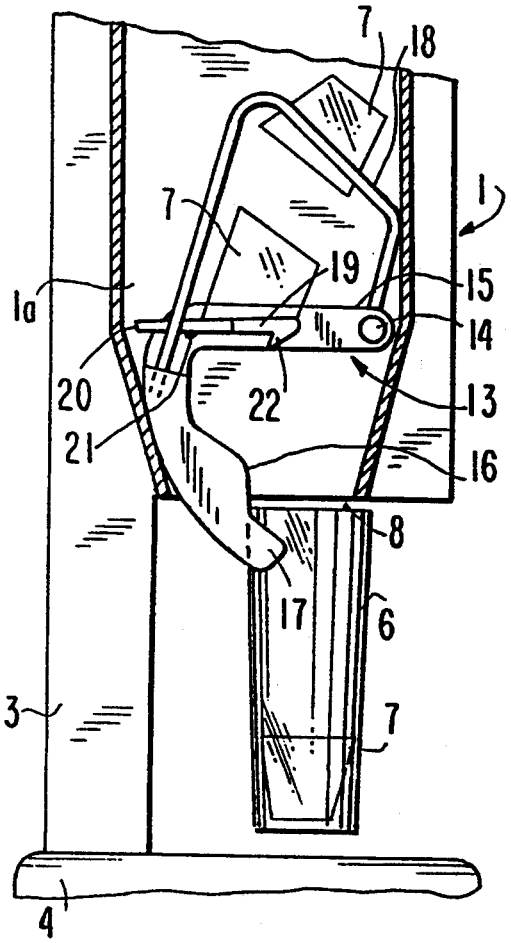
FIG. 4 is a side elevation detail of the mechanism situated in working position.

The combined operation of the components of the ice cube dispensing mechanism illustrated in FIGS. 1 to 5 is as follows:

The glass -6- which is to collect the ice cubes dispensed by the device pushes the pushbutton -17- of the lever -13- so that it swings back and up, so that any ice cube -7- on the platform -16- would fall into the glass (FIG. 4).

When the lever -13- swings up, the rod -18- which was preventing the passage of the ice cubes -7- allows only one of them to pass (FIGS. 2 and 4), and this is intercepted by the trapdoor -19-.

Figure 5:
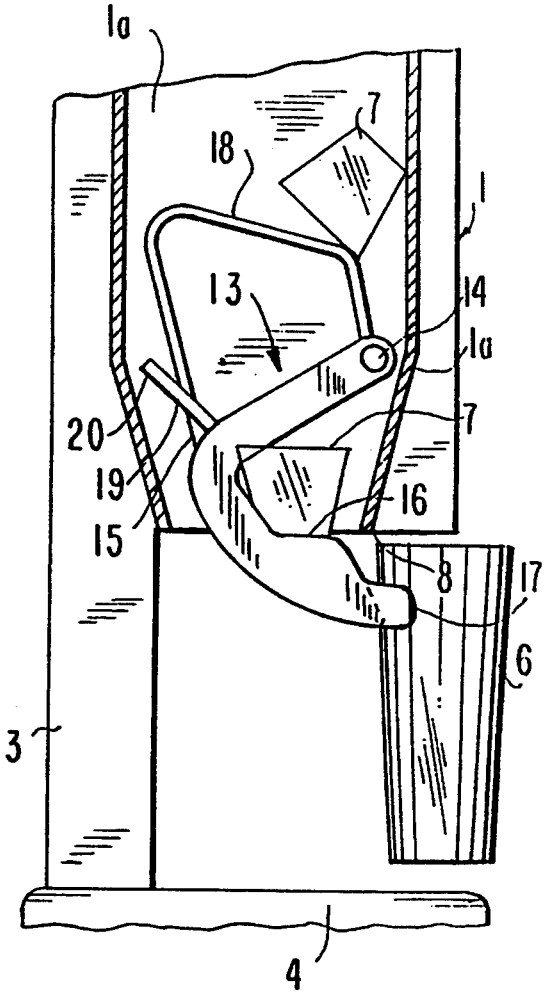
FIG. 5 is a view similar to the previous one, with the mechanism once again at rest. These figures show the first version of the device.
Figure 6:
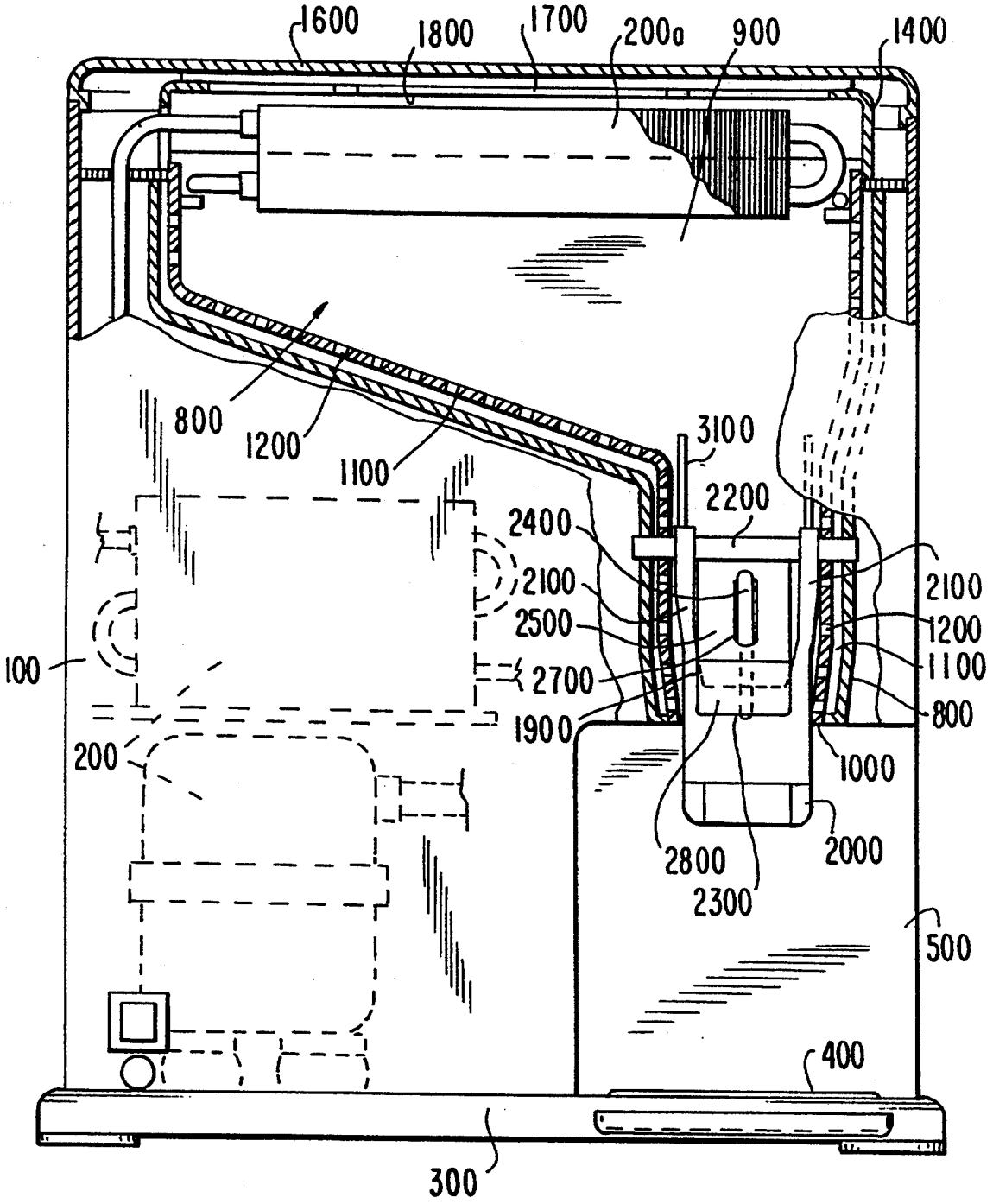
FIG. 6 is a front elevation view, partially sectioned, of the device with the mechanism at rest.
Figure 7:
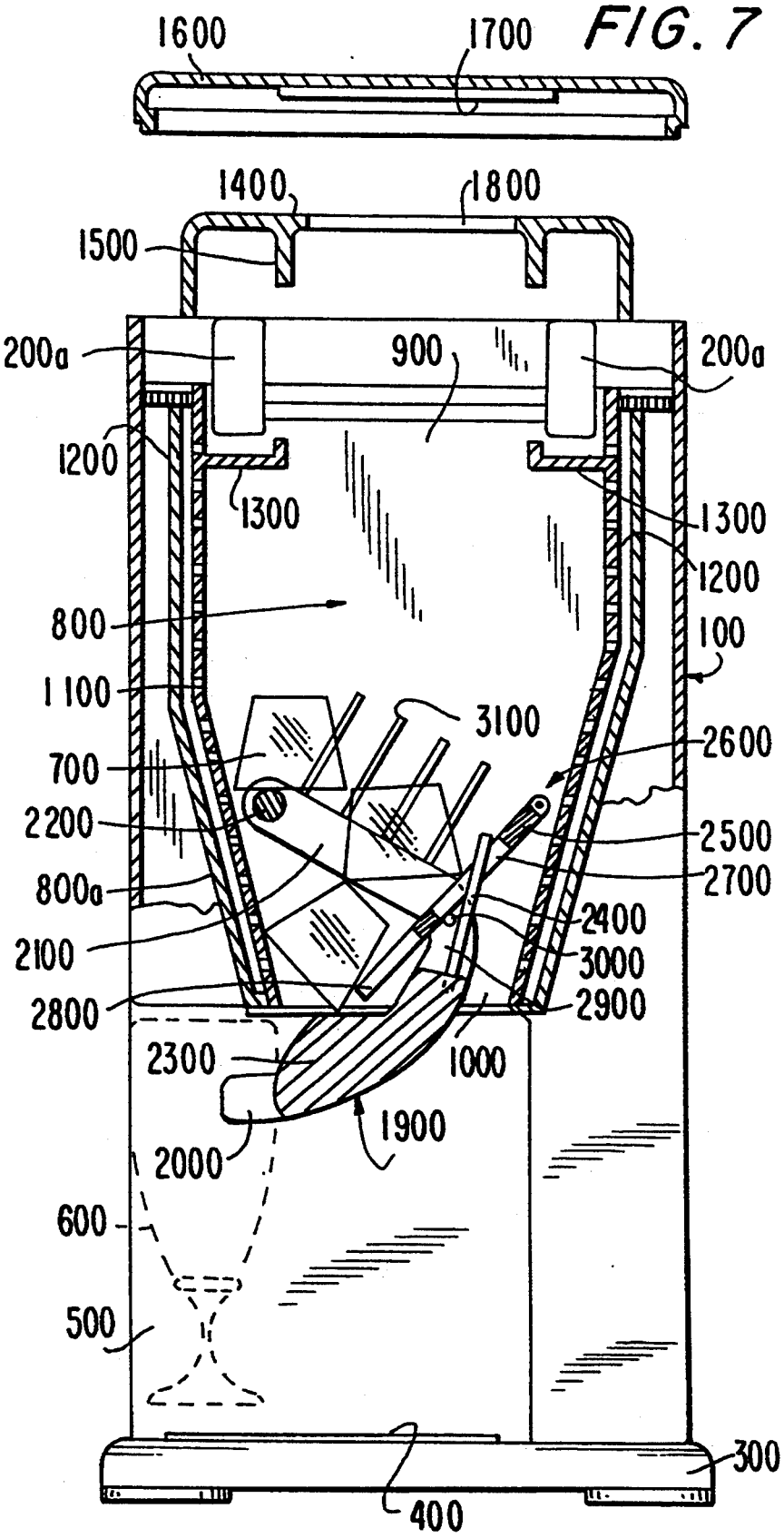
FIG. 7 is a longitudinal section of the device viewed from the side, with the mechanism at rest.

On withdrawal of the glass, the mechanism returns to rest position (either by gravity or with the help of a spring not shown), so that the platform -16- situates itself beneath the opening -8-, closing it off. At the same time the rod -18- recovers its stop position and the trapdoor -19- opens downwards, so that the ice cube placed on it passes onto the platform -16-, waiting for the mechanism to be operated again, thus repeating the cycle described (FIG. 5).

As may be deduced from all the aforegoing and from observation of the drawing, the device in question keeps the ice cubes in unmelted state thanks to the cooling system -2-. Moreover, the ice cubes -7- do not stick together, as the grille -11- prevents the ice cubes from the conventional freezer which are put into the hopper -1*a*- entering stuck together. Furthermore, each time that the dispensing mechanism is operated the rod -18- stirs the ice cubes situated in the hopper -1*a*-.

The device dispenses thee ice cubes -7- manually one by one, and they fall directly into the glass -6-.

In the second version illustrated in FIGS. 6 to 9, the ice cube containing and dispensing device figures in the drawings as having a box -100-, inside which is fitted a cooling unit of general reference -200-. The box -100- is situated on a base -300- with a tray -400- situated beneath a cavity -500- which is open to the exterior, for placement in it of a glass or tumbler -600- in which the ice cubes -700- will be collected.

Inside the box -100- is a hopper-shaped receptacle -800-, open to its upper part for the loading of the ice cubes -700- and with a lower outlet -1000- for exit of same.

This hopper -800- comprises a double wall which gives rise to the formation of an enclosing chamber -1100-, connected to the interior of the hopper by orifices -1200-.

To the upper part -900- of the hopper -800- there are ribbed wings -1300- on which are situated the heat exchange components -200*a*- of the cooling unit -200-. These exchangers are covered with a lid with projections -1500- which, together with the wings -1300-, form housings in which the heat exchange components -200*a*- are enclosed and protected. The box -100- is fitted with a removable cover -1600- with a flexible sheet -1700- which constitutes a watertight gasket which fits and encloses an opening -1800- in the cover -1400-, through which the ice cubes -700- are fed into the hopper -800-.

The mechanism allowing the ice cubes -700- to be dispensed one by one is fitted to the lower part -800*a*- of the hopper. This mechanism consists of an elbowed lever -1900- which has a lower end -2000- in the form of a clamp -1000- projecting through the opening and constituting a pushbutton which has to be pushed by the glass or tumbler -600- which is to collect the ice cubes dispensed by the device. The lever -1900- has two parallel arms -2100- on its inner end, resembling a fork, to the end of which is fitted a lever-rotation spindle -2200-.

The lower part of the lever forms a platform -2300- on which an ice cube -700- is placed in waiting position. Above the position occupied by the aforementioned platform is a projecting rod -2400- which constitutes a guide for a swivelling trapdoor -2500-, revolving around an upper spindle -2600-, with a long opening -2700- through which the rod -2400- passes freely. The trapdoor has a flexible wing -2800- at its lower end.

The lower side of the trapdoor -2500- is provided with a tooth -2900- which, in the rest position of the mechanism, rests on a crosspiece -3000- fitted between the two arms -2100- of the lever -1900-. These two arms have attached to them rods -3100- projecting upwards, to stir the ice cubes -700-.

As can be deduced from all the above and from observation of the drawing, the enclosing chamber -1100- of the hopper -800-, very close to the heat exchangers -200*a*-, distributes the cold through the orifices -1200- in a uniform way throughout the entire hopper, to keep the ice cubes situated in the lower part of same frozen. Moreover, tile condensation provoked by tile presence of the heat exchangers -200*a*- facing the inlet opening -900- is collected by the ribbed wings -1300- and leads out into the chamber -1100- from which the condensation ends in the evaporator, thus avoiding the formation of frost inside the hopper -800-.

In respect of the ice cube dispensing mechanism, it will be understood that, in the rest position, one of the cubes remains on the waiting platform -2300- (FIG. 7), while the others contained in the hopper -800- are separated from that platform by the trapdoor -2500- with the flexible wing -2800-.

Figure 8:
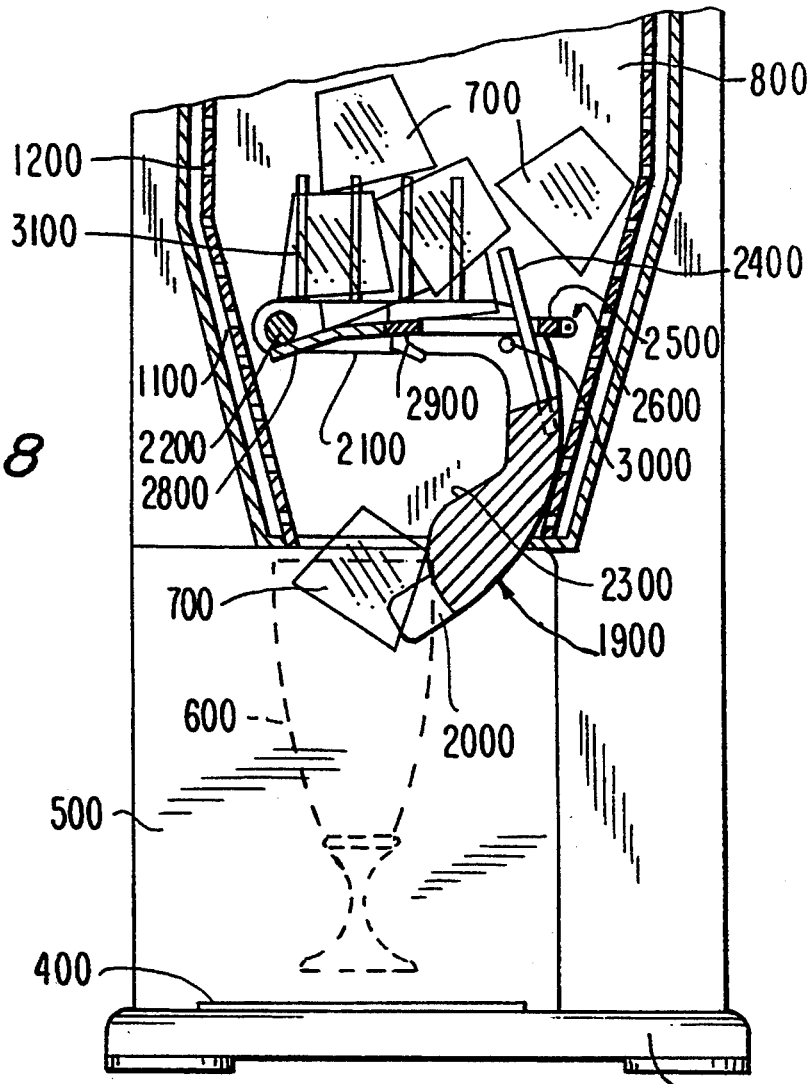
FIG. 8 is a view similar to that of FIG. 7, with the mechanism in ice cube delivery position.
Figure 9:
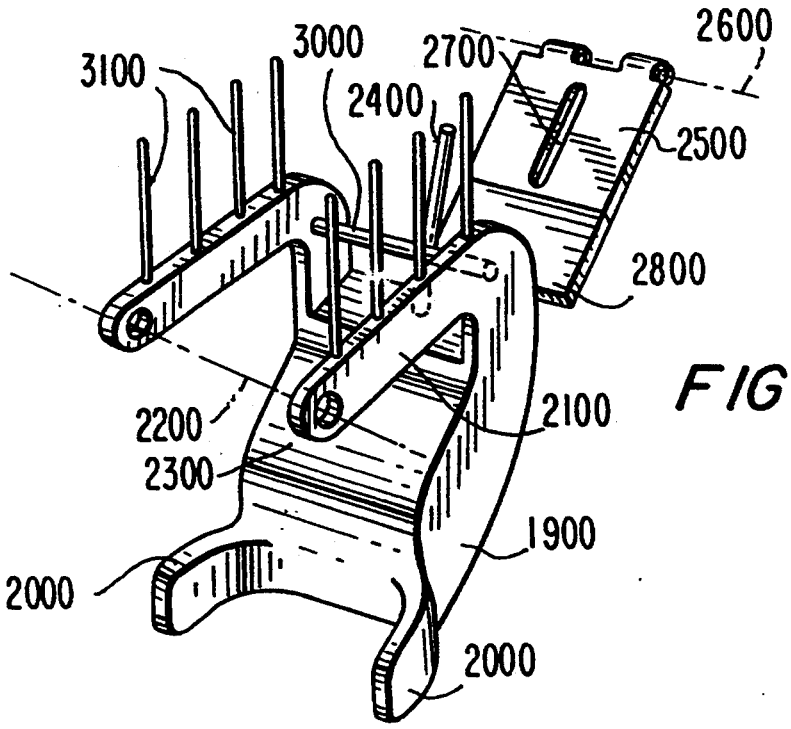
FIG. 9 is a perspective view of the main components of the mechanism disassembled.

When the lever -1900- is pushed by a glass or tumbler -600-, pressing its lower end, the lever swivels upwards, the crosspiece -3000- pushes the trapdoor -2300- to situate it in a practically horizontal position, so that during the drop of the ice cube which was on the platform -2300- the other ice cubes don't fall with it at the same time (FIG. 8). During this movement the rods -3100- stir the ice cubes in order to facilitate their one-by-one transfer towards the platform -2300-, which transfer takes place when the lever -1900- regains its original rest position.

What is claimed is:

1. An ice cube containing and dispensing device which comprises a thermally insulating receptacle (1) incorporating a cooling unit (2) and provided with an ice cube loading opening (9), said receptacle presenting a configuration in the form of a hopper (1*a*) with a outlet opening (8) for ice cubes (7) to emerge, comprising a manually operated mechanism arranged in said receptacle and which tends to remain in a stable rest position in which it intercepts the passage of ice cubes toward the outlet opening (8), such that when operated manually, the mechanism permits passage of ice cubes, said mechanism comprising a lever (13) provided with a projecting section underneath the ice cube outlet Opening in the form of a pushbutton (17), a platform (16) which closes off said outlet opening (8), an upper stop (18) attached to the lever (13) in an interior of said hopper, said upper stop (18) constituting means for regulating the passage of an ice cube from the hopper to said platform such that When the lever is in a rest position, said stop preventing passage of ice cubes toward the platform, and allowing ice cubes to pass when the lever is moved, and an intermediate movable trapdoor (19) coupled to and operated by said lever (13), said trapdoor (19) being arranged between said upper stop (18) and said platform (16), said trapdoor (19) being inactive in a rest position of said lever (13) and being moved, when said pushbutton (17) is pressed, to a position in which it intercepts the passage of an individual ice cube which has gone beyond said upper stop (18) preventing it from reaching said platform (16) until the mechanism returns to its rest position.

2. An ice cube containing and dispensing device including a thermally insulating receptacle incorporating cooling means, said receptacle comprising a hopper having an ice cube loading opening through which ice cubes are placed into said hopper and a lower outlet opening for delivering ice cubes individually into glasses, comprising a manually operated mechanism arranged in said receptacle and which tends to remain in a stable rest position in which it intercepts the passage of ice cubes toward the outlet opening, said mechanism comprising a lever provided With a projecting section underneath the ice cube outlet opening in the form of a pushbutton and a platform which closes off said outlet opening, whereby upon movement of said lever via said pushbutton, the mechanism permits passage of individual ice cubes to said platform and through said lower outlet opening, and a grille provided with openings and arranged under said ice cube loading opening, said openings in said grille having a size substantially corresponding to the size of the ice cubes, thereby preventing the passage of two or more ice cubes stuck together into said hopper.

3. Ice cube containing and dispensing device as claimed in claim 1, further comprising a grille (11) provided with openings (12) arranged under said loading opening of said receptacle, said openings of said grille having a size substantially corresponding to the size of the ice cubes, thereby preventing the passage of two or more ice cubes stuck together.

4. Ice cube containing and dispensing device as claimed in claim 1, further comprising a base for supporting the device on a horizontal surface, said receptacle (1) being mounted on said base (4), said base having a tray-type configuration situated beneath said ice cube outlet opening, at a distance sufficient to allow the positioning of a glass (6) for receiving the ice cubes supplied by the device.

5. Ice cube containing and dispensing device as claimed in claim 1, wherein said ice cube container hopper comprises a first, inner wall and a second, outer wall defining an enclosing chamber (1100) therebetween, said first, inner wall comprising orifices for coupling said enclosing chamber to an interior of the hopper so that the cold generated by the cooling unit spreads evenly throughout said hopper, said cooling unit comprising heat exchange components (200*a*), said enclosing chamber being coupled to an area in which the heat exchange components (200*a*) are situated.

6. Ice cube containing and dispensing device as claimed in claim 5, wherein the heat exchange components (200*a*) are situated beside the ice cube loading opening (900), further comprising means for housing the heat exchange components (200*a*), said means being provided with orifices (1200) to link said housing means with the enclosing chamber (1100) of the hopper.

7. Ice cube containing and dispensing device as claimed in claim 1, further comprising a cube entrance cover (1600) for covering the ice cube loading opening, said cube entrance cover being provided with a flexible plate (1700) in the form of a water-tight gasket.

8. Ice cube containing and dispensing device as claimed in claim 1, wherein said lever (13) is a mechanism operating lever (1900) comprising two arms (2100) and a stop (3000) extending between said arms, further comprising a swivelling trapdoor (2500) resting on said stop of said mechanism operating lever, said swivelling trapdoor having a prolongation in the shape of a flexible wing (2800) and a long opening (2700), and a rod connected to said mechanism operating lever and arranged to pass through said long opening in said swivelling trapdoor, said rod guiding the swivelling movement of the trapdoor.

9. Ice cube containing and dispensing device as claimed in claim 8, further comprising projecting rods (3100) connected to said arms (2100) of said mechanism operating lever (1900), said projecting rods (3100) being oriented toward an interior of said hopper.

10. An ice cube containing and dispensing device, comprising a thermally insulating receptacle incorporating cooling means, said receptacle comprising a hopper having an interior, an ice cube loading opening through which ice cubes are placed into said hopper interior and a lower outlet opening for delivering ice cubes individually into glasses from said hopper interior, and a manually operated mechanism arranged in said receptacle and which tends to remain in a stable rest position in which it intercepts the passage of ice cubes toward the outlet opening, said mechanism comprising a lever provided With a projecting section underneath the ice cube outlet opening in the form of a pushbutton and a platform which closes off said outlet opening, whereby upon movement of said lever via said pushbutton, the mechanism permits passage of individual ice cubes to said platform and through said lower outlet opening, said hopper comprising a first, inner wall and a second, outer wall defining an enclosing chamber therebetween, said first wall comprising orifices for coupling said enclosing chamber to said hopper interior so that the cold generated by the cooling means spreads evenly throughout said hopper interior, said cooling means comprising heat exchange components, said enclosing chamber being coupled to an area in which the heat exchange components are situated.

11. Ice cube containing and dispensing device as claimed in claim 1, further comprising means for preventing the passage of two or more ice cubes stuck together.

12. Ice cube containing and dispensing device as claimed in claim 1, wherein said mechanism further comprises a spindle about which said mechanism rotates, said upper stop and said lever being connected to said spindle, said spindle being fixed to said hopper in an interior thereof.

13. Ice cube containing and dispensing device as claimed in claim 1, further comprising a spindle arranged in an interior of said hopper, said trapdoor being arranged to swivel about said spindle, and means for limiting the swivelling movement of said trapdoor, said means comprising lugs arranged on said lever and a tooth provided on said trapdoor.

14. Ice cube containing and dispensing device as claimed in claim 8, further comprising means coupled to said mechanism operating lever for stirring the ice cubes in said hopper.

15. An ice cube containing and dispensing device, comprising a thermally insulating receptacle incorporating cooling means, said receptacle comprising a hopper having an interior, an ice cube loading opening through which ice cubes are placed into said hopper interior and a lower outlet opening for delivering ice cubes individually into glasses from said hopper interior, a manually operated mechanism arranged in said receptacle and which tends to remain in a stable rest position in which it intercepts the passage of ice cubes toward the outlet opening, said mechanism comprising a lever provided with a projecting section underneath the ice cube outlet opening in the form of a pushbutton, a stop connected to said lever and extending into an interior of said hopper and a platform which closes off said outlet opening, whereby upon movement of said lever via said pushbutton, the mechanism permits passage of individual ice cubes to said platform and through said lower outlet opening, and said mechanism further comprising a movable trapdoor resting on said stop of said lever, said trapdoor having a prolongation in the shape of a flexible wing and an elongate opening, and a rod connected to said lever and arranged to pass through said elongate opening in said trapdoor, said rod guiding swivelling movement of said trapdoor.

* * * * *